US006541726B2

(12) United States Patent
Schellekens et al.

(10) Patent No.: US 6,541,726 B2
(45) Date of Patent: Apr. 1, 2003

(54) VACUUM CARTRIDGE IN PARTICULAR FOR AN ELECTRICAL PROTECTION APPARATUS SUCH AS A SWITCH OR A CIRCUIT BREAKER

(75) Inventors: Hans Schellekens, La Terrasse (FR); Denis Giraud, Gieres (FR); Serge Olive, Saint Paul de Varces (FR); Christophe Arnaud, Vif (FR)

(73) Assignee: Schneider Electric Industries SA (FR)

( * ) Notice: Subject to any disclaimer, the term of this patent is extended or adjusted under 35 U.S.C. 154(b) by 0 days.

(21) Appl. No.: 09/828,878

(22) Filed: Apr. 10, 2001

(65) Prior Publication Data

US 2001/0047981 A1 Dec. 6, 2001

(30) Foreign Application Priority Data

May 2, 2000 (FR) ..... 0005587

(51) Int. Cl.[7] ..... H01H 33/66
(52) U.S. Cl. ..... 218/123; 218/128
(58) Field of Search ..... 218/121–123, 218/128–129, 118

(56) References Cited

U.S. PATENT DOCUMENTS 4,473,731 A * 9/1984 Yorita ..... 200/238
4,629,839 A * 12/1986 Falkingham ..... 218/128
4,704,506 A 11/1987 Kurosawa et al.
4,935,588 A * 6/1990 Hess et al. ..... 218/123
5,737,340 A 4/1998 Tamarapalli et al.

FOREIGN PATENT DOCUMENTS

DE 39 41 388 A1 6/1991
GB 1125734 8/1968

* cited by examiner

*Primary Examiner*—Elvin Enad
*Assistant Examiner*—M. Fishman
(74) *Attorney, Agent, or Firm*—Parkhurst & Wendel, L.L.P.

(57) ABSTRACT

A vacuum cartridge, in particular for an electrical protection apparatus such as a switch or circuit breaker, comprising an enclosure of appreciably cylindrical shape closed by two end-plates, two contacts extending axially inside the enclosure, at least one of which contacts called the movable contact is connected to an operating mechanism and is slidingly mounted between a closed position of the contacts corresponding to a rest position of the apparatus and a position in which the arcing contacts are separated and form an electric arc between them, separation of the contacts resulting in breaking of the electrical circuit, and a means for producing an axial magnetic field for diffusion of the arc in the arc formation area. The cartridge comprises means for speeding up cooling of the contact material in liquid form flowing on the contact surface of said arcing contacts during breaking.

18 Claims, 6 Drawing Sheets

VACUUM CARTRIDGE IN PARTICULAR FOR AN ELECTRICAL PROTECTION APPARATUS SUCH AS A SWITCH OR A CIRCUIT BREAKER

BACKGROUND OF THE INVENTION

The present invention relates to a vacuum cartridge in particular for an electrical protection apparatus such as a switch or circuit breaker, said cartridge comprising an enclosure of appreciably cylindrical shape closed by two end-plates, two arcing contacts extending axially inside the enclosure, at least one of which contacts called the movable contact is connected to an operating mechanism and is slidingly mounted between a closed position of the contacts corresponding to a rest position of the apparatus and a position in which the arcing contacts are separated and form an electric arc between them, separation of the contacts resulting in breaking of the electrical circuit, and a means for producing an axial magnetic field for diffusion of the arc in the arc formation area.

A cartridge of this kind is described for example in the documents FR 2,682,808 or FR 2,726,396.

The present invention is based on the following new observations. The behavior of the electric arc is such that in spite of the presence of large axial magnetic fields, the arc is all the more concentrated the greater the current intensity. The diffused arc, covering the whole surface of the contacts when breaking takes place with a weak current, is transformed into an arc in the form of a column, which arc heats a small part (10%) of the arcing contact surface intensely.

This electric arc, due to the high concentration of its intensity, causes melting of the contact material at the foot of the arc. The resulting liquid spreads over the whole of the contact surfaces. Thus, the liquid distributes the arcing energy above the contacts. This causes cooling of the arc in two stages. Firstly, the arc heats the contact material until the latter melts, then the liquid flows out of the arcing area. Solutions have been proposed to distribute the arcing energy better so as to increase the breaking capacity. All these solutions act directly on the arc, for example enlarging the surface of the arc, subdividing the arc or making the arc move.

Cartridges are moreover also known wherein the contacts are provided with slits. These slits are designed to reduce the induced currents in case of an axial magnetic field being used, or to create either a radial or an axial magnetic field.

OBJECT OF THE INVENTION

The object of the present invention is to improve the breaking capacity of cartridges of this kind without exerting any manipulation on the arc.

For this purpose, the object of the present invention is to achieve a vacuum cartridge of the previously mentioned kind, this cartridge being characterized in that it comprises means, called first means, to speed up cooling especially of the contact material in liquid form flowing on the contact surface of the contact or contacts during breaking, said liquid coming from melting of the contact material due to the concentration effect of the arc during breaking.

According to a particular embodiment of the invention, these first means comprise means, called second means, for increasing the contact surface between the contact(s) and the above-mentioned liquid so as to create surfaces hidden for the arc but accessible for the liquid.

According to a particular embodiment, these means comprise at least one slit made in one or each of the contacts and arranged in such a way as to receive the above-mentioned liquid and facilitate flow thereof.

Thus, in this embodiment, the slits are arranged to receive the liquid, unlike known cartridges of the prior art comprising slits in the contacts. In the latter cartridges, the contact liquid, due to its capillarity and to the arrangement of these slits, does not in fact flow inside the slits.

According to another particular embodiment, these second means comprise at least one groove designed to receive the above-mentioned liquid and extending radially inside the contact(s), from close to the central part of the contact(s) up to its (their) periphery.

According to another embodiment, these second means comprise at least one orifice made in one or each of the contacts, said orifice(s) joining the upper face and the lower face of the (or each) contact and presenting a diameter smaller than the diameter of the electric arc.

According to another feature, these first means comprise means called third means for increasing the speed of flow of the liquid.

Advantageously, these first means comprise second means and third means, the second means comprising slits and, according to the third means, the angle formed between the direction of the initial flow of the liquid and the inlet direction of the liquid into the slits is smaller than or equal to 90°.

According to another feature, according to these second means, one or each of the arcing contacts is hollow and comprises an orifice in its contact surface giving access to the opposite surface of the contact(s), which opposite surface thus takes part in cooling, supply of the contact(s) being performed via the periphery of the contact(s).

According to a particular feature, the edge(s) of the contact(s) is (are) cut in such a way as to form a coil designed to create the above-mentioned axial magnetic field for diffusion of the arc.

According to another particular feature, the axial magnetic diffusion field created is a multipole field and one or each of the contacts comprises as many orifices as poles.

BRIEF DESCRIPTION OF THE DRAWINGS

But other advantages and features of the invention will become more clearly apparent from the following detailed description which refers to the accompanying drawings given as non-restrictive examples only and in which.

DETAILED DESCRIPTION OF THE PREFERRED EMBODIMENTS

Figure 1:
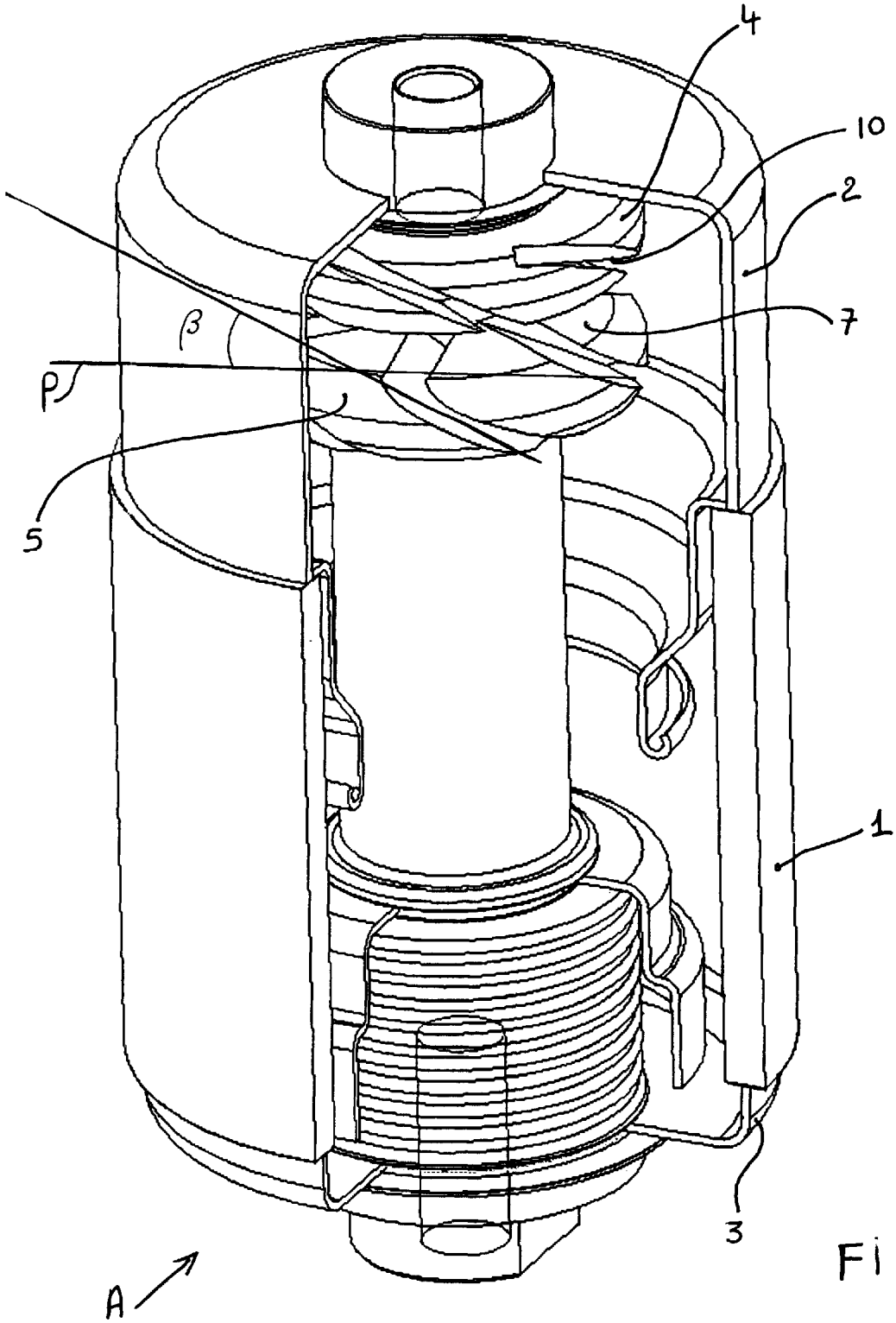
FIG. 1 is a perspective view of a vacuum cartridge according to a first embodiment of the invention.
Figure 7:
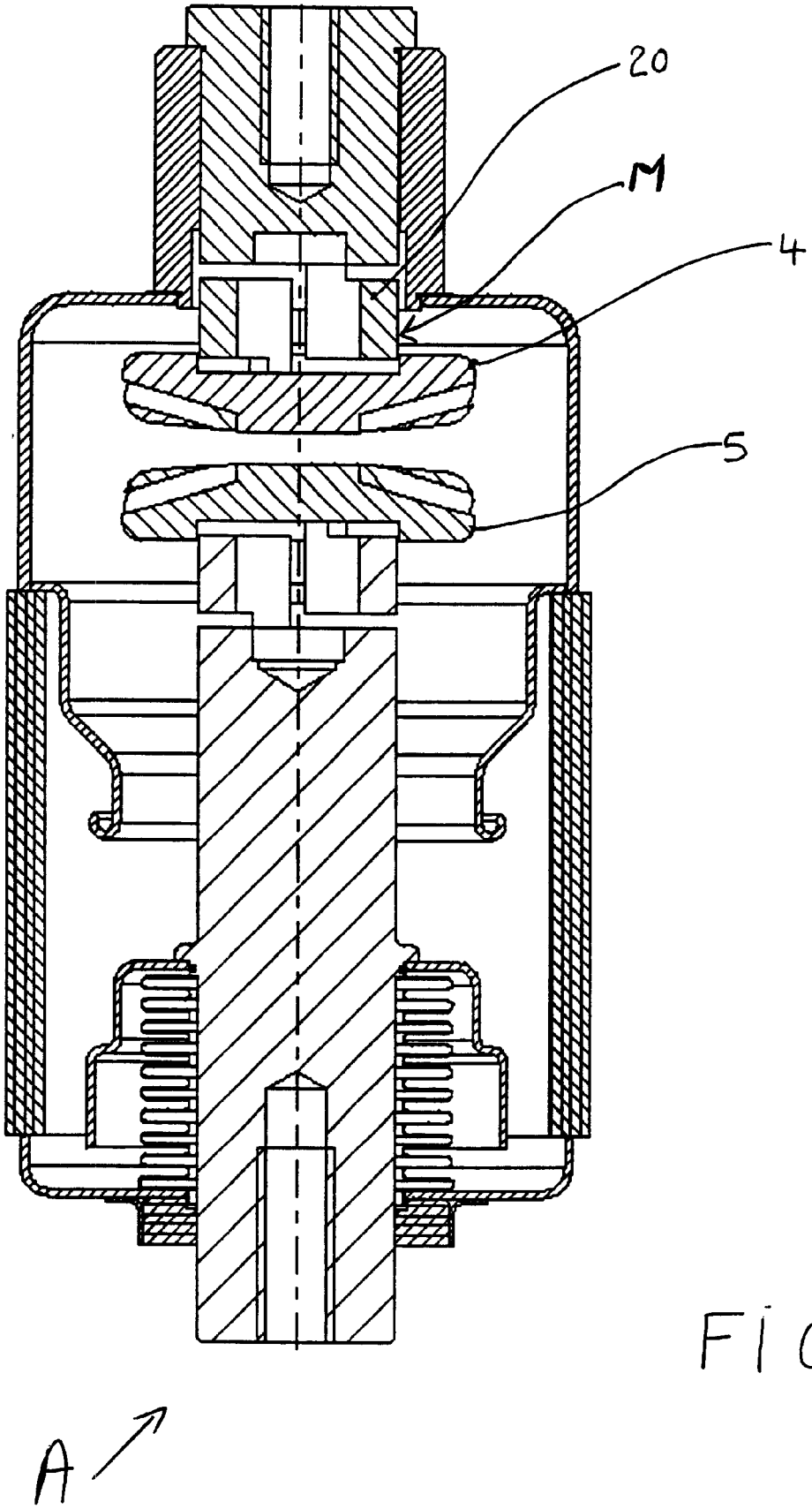
FIG. 7 illustrates in an axial sectional view a vacuum cartridge according to the invention, of simplified design.

In FIGS. 1 and 7, a vacuum cartridge A can be seen designed in particular to be integrated in a medium-voltage electrical circuit breaker in order to perform breaking of an electrical circuit in the event of a fault or when a deliberate opening command of the electrical circuit is performed.

This cartridge A comprises in a manner known as such an enclosure 1 of cylindrical shape closed by two end-plates 2,3, two contacts 4,5, one 4 of said contacts called the stationary contact being securedly affixed to one 2 of the end-plates whereas the other contact 5, called the movable contact, is connected to an operating mechanism (not represented) and is mounted sliding axially inside the enclosure 1 between a closed position of the contacts 4,5 corresponding to a rest position of the circuit breaker and a position in which the contacts 4,5 are separated and form an electric arc between them, separation of the contacts resulting in breaking of the electrical circuit. This cartridge A comprises in addition a means M (FIG. 7) for producing an axial magnetic field designed to perform diffusion of the arc between the contacts. Each contact 4,5 is formed by a part made of a base material 6 comprising on its contact face 7 a material called contact material 8 able to be made of the same material as the base material.

According to the invention, this cartridge A comprises means, called the first means, to foster cooling of the contact material 8 in liquid form flowing on the contact surface 7 of the contacts 4,5 during breaking.

According to a first embodiment of the invention, these means comprise means called second means for increasing the contact surface between the liquid and the contacts 4,5.

Figure 2:
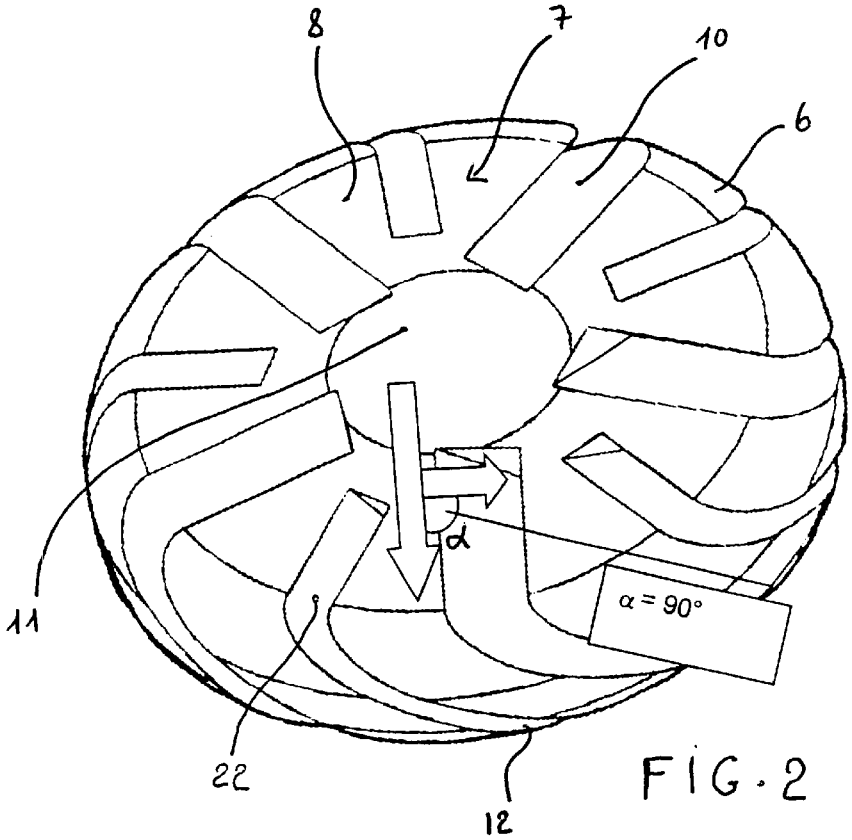
FIG. 2 is a perspective view of one of the arcing contacts of the cartridge illustrated in the previous figure.

According to the embodiments illustrated in FIGS. 1 and 2, these second means comprise slits 10 made in one or both of the contacts 4,5. Each (or one) of the two contacts 4,5 comprises a certain number of slits 10 passing partially through the thickness of the contact(s) 4,5 and extending radially from close to the central part 11 of the contact(s) 4,5 up to its (their) periphery (12). In FIG. 1 in particular, it can be seen that the slits 10 each extend in a plane forming an angle β comprised between 10° and 80° but preferably between 10° and 45°, advantageously 30°, with the plane P of the contact surfaces 7 of the contacts 4,5 so as to facilitate inlet of the liquid.

Figure 3:
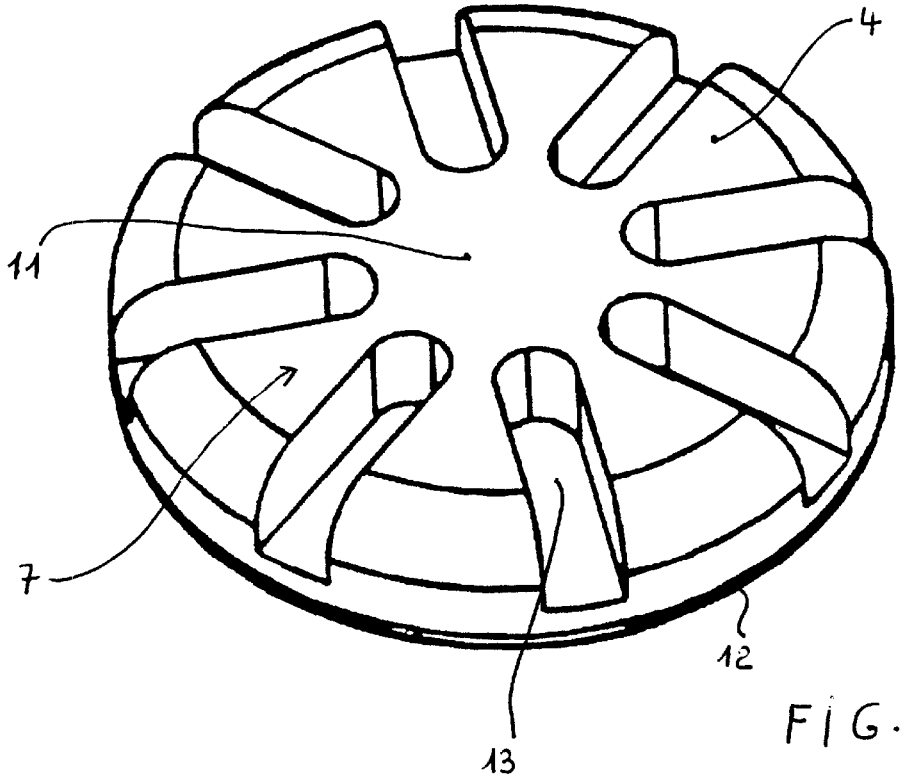
FIG. 3 is a perspective view illustrating another embodiment of an arcing contact according to another embodiment of the invention, FIGS. 4, 5 and 6 respectively illustrate three other embodiments of an arcing contact according to the invention.

According to the embodiment illustrated in FIG. 3, the (or each) contact 4,5 is (are) provided with grooves 13 designed to receive the above-mentioned liquid and extending radially, said grooves being arranged over the contact surface 7 of the contacts 4,5, all around the contacts 4,5, from close to the central part 11 of the contact(s) 4,5 up to its (their) periphery 12. According to another embodiment, not illustrated, these second means comprise an orifice arranged in the center of the contact(s) 4,5, said orifice joining the upper face to the lower face of the contact, this arrangement being efficient if the arc roots bum around the orifice.

Figure 4:
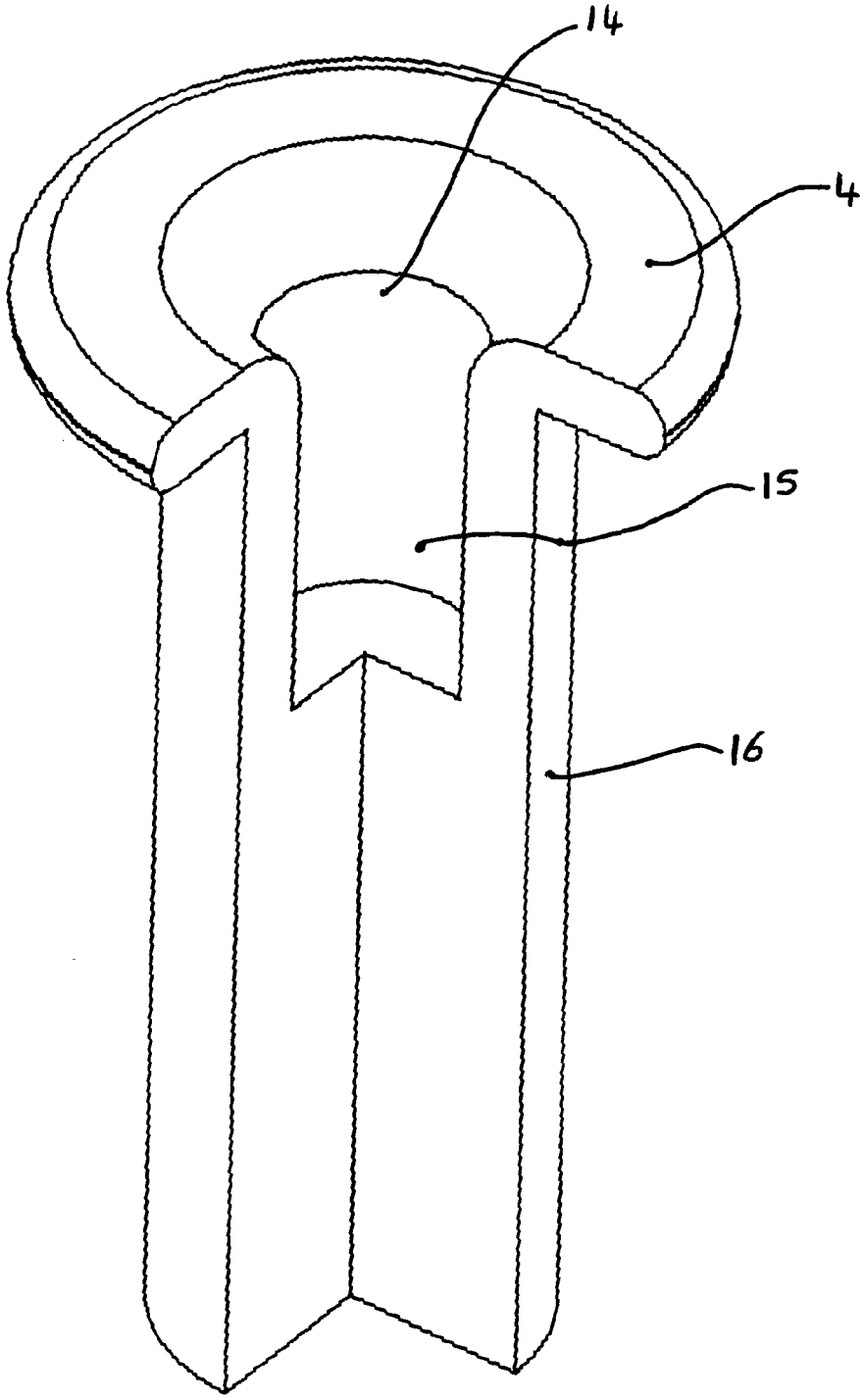

According to another embodiment illustrated in FIG. 4, these second means comprise for one or each of the contacts 4,5, a first orifice 14 provided in the middle of the contact 4 and giving access to a cylindrical second orifice 15 provided in the rod 16 of said contact. In this embodiment, the diameter of the orifices is smaller than the diameter of the arc.

Furthermore, in this embodiment, the circumference of the arc is increased, which has the effect of increasing the quantity of liquid which can flow from the arc to the external or internal periphery of the contacts.

Figure 5:
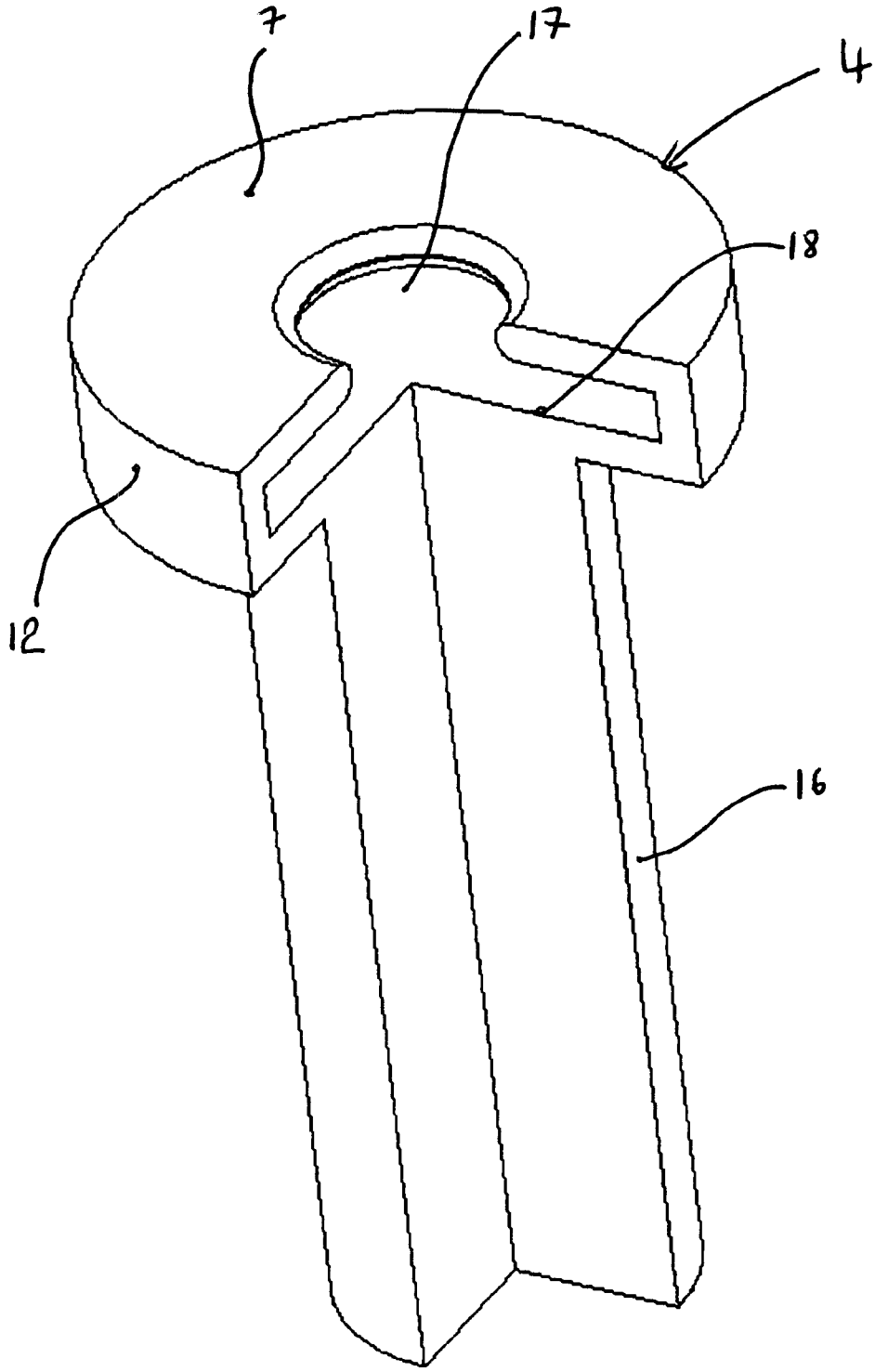

According to another embodiment illustrated in FIG. 5, the (or each of the) arcing contact(s) is (are) hollow and presents, on its (their) contact surface 7, an orifice 17 giving access to its (their) opposite surface 18. In this case, supply of the contact(s) 4,5 is performed via its (their) periphery and the opposite surface 18 therefore takes part in cooling.

Advantageously, the contact 4,5 is cut in such a way as to create a coil (not represented) designed to create the axial magnetic field for diffusion of the above-mentioned arc.

In all these embodiments providing an orifice in the contact surface, the diameter of the orifice has to be smaller than the diameter of the electric arc to obtain an increase of the contact surface between the liquid and the contacts.

Advantageously, the diameter of the orifice is comprised between 0.1 and 0.3 times the external diameter of the contacts.

Thus, in all these embodiments, the contact surface between the arcing contacts 4,5 and the liquid has been increased. This additional surface is hidden (hidden surfaces 22) for the arc plasma but at the same time accessible for the liquid, in particular when the latter flows following the slight slope of the wings of the slits 10. It has been observed that a 50% increase of the contact surface enables the breaking capacity to be increased by 20%.

According to another embodiment of the invention, this first means for facilitating cooling of the contact material comprises a means, called the third means, for increasing the speed of flow of the material in liquid form on the contacts so that the liquid reaches the surfaces located away from the arc root more easily. One of the means for improving the flow of the liquid in the direction of the surfaces located away from the arc root could consist in playing on the wettability between the liquid and the base material. This wettability can be improved either by adjusting the composition of the molten contact material or by changing the nature of the material on which the contact material flows.

Another means for increasing the speed of flow could consist in reducing the roughness of the contact surface for example by polishing the surface by mechanical or chemical means, or by having polishing performed by the arc.

It will be advantageous to use in combination a means for increasing the contact surface and a means for facilitating the flow.

Thus, a means for facilitating the flow will be able to be used in combination with the slits. This means will be able to consist in facilitating inlet to the slits. To do this and as illustrated in FIG. 2, the angle α between the initially radial direction of the flow of the liquid and the direction of the slits has to be smaller than or equal to 90°. Such an inlet angle of the slits will have the effect of increasing the breaking capacity by up to 5%.

Another means for facilitating inlet into the slits will be able to consist in choosing the direction of the axial magnetic field in such a way that the liquid is driven in the direction of the slits. The current flowing in the contacts in fact flows through the liquid layer as well. At the surface, the current has axial and radial components. In the presence of the magnetic field, the latter creates Lorentz forces with the current, which forces act on the liquid. It should be recalled that this magnetic field is created by a coil provided outside or behind the contacts. A suitable choice of the direction of the field enables the breaking capacity to be increased by 2%.

The table below indicates the breaking capacity of different vacuum cartridges according to their surface, the number of slits and the inlet angle.

| Type | Surface in sq.mm | Slits | Inlet angle | Breaking capacity in kA rms |
|---|---|---|---|---|
| Standard | 1846 | None | — | 29.3 |
| FIG. 2 | 2655 | 6 inclined | 60° | 33.5 |
| FIG. 2 | 3358 | 10 inclined | 90° | 40.5 |
| FIG. 3 | 3097 | 8 grooves | 0° | 36.0 |

In addition to all these means, it will be advantageous to subdivide the arc so as to generate several heat sources, which will enhance the flow and cooling even further. A known technique for dividing the arc consists in applying a magnetic field called multipole.

Figure 6:
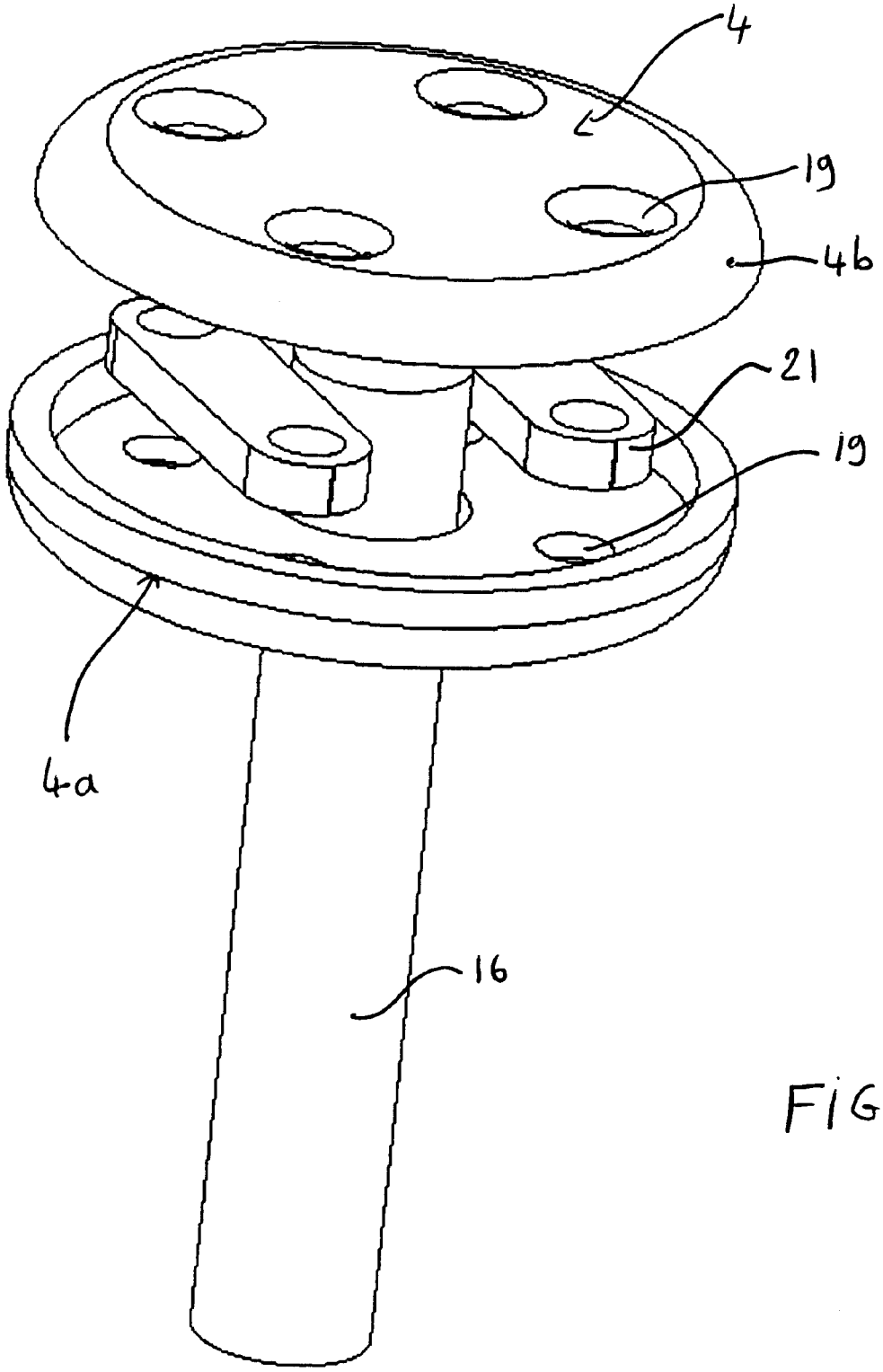

According to the embodiment illustrated in FIG. 6, each of the contacts 4 comprises two contact parts 4*a*,4*b*, each contact part comprising four pass-through orifices 19, the orifices 19 of one 4*a* of the contact parts being located facing the orifices 19 of the other 4*b* of the contact parts. Thus, the arc will subdivide into several parallel arcs and into as many liquid metal sources. The magnetic field is created on the one hand by ferromagnetic parts 21 situated inside the contacts, and on the other hand by the relative rotation between the two contacts in such a way that the magnetic resistance is minimal for the field lines which pass through the space between the contacts. Supply of the contacts is performed in the center of the contacts so as to be able to magnetize the ferromagnetic parts correctly. Advantageously, the diameter of the orifices is comprised between 0.05 and 0.4 times the external diameter of the contacts.

It results from the observation made at the beginning of this text whereby the arc is transformed into a diffused arc in the form of a column, that the axial magnetic field is only partially used by the arc. Thus, in the embodiment described in FIG. 7, the effects of the magnetic field have been limited to the places where the arc is situated. To do this, a coil 20 reduced in diameter was placed behind the contacts 4,5, said coil 20 creating an axial magnetic field which is sufficiently strong at the center of the contacts 4,5 but very weak or even in the opposite direction everywhere else. This particular embodiment on the one hand enables a cartridge of simplified design to be achieved, and on the other hand limits the losses induced by the coils and therefore the temperature increase resulting from generation of the magnetic field.

A vacuum cartridge presenting a particularly improved breaking capacity while keeping a simple structure and small dimensions has therefore been achieved by means of the invention. Naturally the invention is not limited to the embodiments described and illustrated which have been given for example purposes only.

On the contrary, the invention extends to encompass all the technical equivalents of the means described and combinations thereof if the latter are performed according to the spirit of the invention.

What is claimed is:

1. A vacuum cartridge for an electrical protection apparatus, said cartridge comprising:

a substantially cylindrical enclosure having a longitudinal axis and closed by two end-plates, two contacts for location in an electrical circuit, the centers of said contacts located along the longitudinal axis inside the enclosure, at least one of said contacts being a movable contact connected to an operating mechanism and slidingly mounted between a closed position of the contacts and a separated position for forming an electric arc between them, wherein separation of the contacts results in breaking of the electrical circuit, and a means for producing an axial magnetic field for diffusion of an arc located in at least one arc formation area, comprising means for increasing a rate of cooling of contact material in liquid form flowing on a contact surface of at least one of said contacts during movement from said closed position to said separated position, such liquid being contact material melted by an electric arc located in at least one arc formation area during said movement.

2. The vacuum cartridge according to claim 1, wherein said means for producing an axial magnetic field further comprises means for increasing an area of the contact surface between at least one of said contacts and such liquid, said increased amount of contact surface area being inaccessible to an electric arc located in at least one arc formation area during said movement but accessible to such liquid.

3. The vacuum cartridge according to claim 2, wherein said means for increasing the contact surface area between at least one of said contacts and such liquid comprises at least one slit in at least one contact surface, said at least one slit located for receiving and facilitating flow of such liquid.

4. The vacuum cartridge according to claim 3, wherein said means for increasing the such liquid comprises a plurality of slits located around the at least one contact, each of said slits extending radially from a central portion of the contact to a periphery of the contact.

5. The vacuum cartridge according to claim 3, wherein the contact surface defines a plane, and each slit includes a surface for ducting said liquid having a liquid draining direction defining an angle between 10 and 80° with the plane.

6. The vacuum cartridge according to claim 2, wherein said means for increasing the contact surface area between at least one of said contacts and such liquid comprises at least one groove for receiving such liquid and extending radially inside the at least one contact, from a central portion of the contact to the periphery of the contact.

7. The vacuum cartridge according to claim 2, wherein each of said contacts has an upper and a lower face, and said means for increasing the contact surface area between at least one of said contacts and such liquid comprises at least one orifice in fluid communication between the upper face and the lower face of at least one corresponding contact, the orifice having a diameter smaller than a diameter of an electric arc located in the at least one arc formation area during said movement.

8. The vacuum cartridge according to claim 2, wherein:

a rod integral with said contact and coaxial with said axis, additionally comprising at least one one contact, wherein said means for increasing the contact surface area between at least one of said contacts and the liquid comprises:

at least one orifice having a first diameter located in said at least one contact, said orifice located at substantially the center of the contact and in fluid communication with a cylindrical void having a second diameter and located in the rod, the first diameter of the at least one orifice and the second diameter of the void being smaller than a diameter of an electric arc located in the at least one arc formation area during said movement.

9. The vacuum cartridge according to claim 1, wherein said means for producing an axial magnetic field further comprises means for increasing a speed of flow of such liquid.

10. The vacuum cartridge according to claim 3, wherein said means for increasing the contact surface area between at least one of said contacts and such liquid comprises at least one slit located in at least one contact, and an angle between a direction of initial flow of such liquid and the direction of the liquid flowing in the at least one slit is at least 90°.

11. The vacuum cartridge according to claim 9, further comprising:

means for increasing said contact surface area between at least one of said contacts and such liquid comprising at least one slit in at least one contact, said at least one slit having an inlet, wherein means for increasing a speed of flow of such liquid comprises means for producing an axial magnetic field having a magnetic direction for propelling the liquid in a direction toward the inlet of the at least one slit.

12. The vacuum cartridge according to claim 1, wherein the contact surface of said at least one contact is polished for increasing a rate of flow of such liquid.

13. The vacuum cartridge according to claim 1, further comprising stationary contact means for generating several heat sources by sub-dividing an electric arc located in the at least one arc formation area during said movement.

14. The vacuum cartridge according to claim 1, wherein the means for producing the axial magnetic field for diffusion of an electric arc located in at least one arc formation area during said movement, comprises means for producing a magnetic field substantially coextensive with said arc location.

15. The vacuum cartridge according to claim 2, wherein said means for increasing the contact surface area between at least one of said contacts and such liquid comprises at least one hollow contact having an orifice in a contact surface, said orifice in fluid communication with an interior surface of said hollow contact for cooling said hollow contact.

16. The vacuum cartridge according to claim 15, wherein said at least one contact further comprises an edge having a profile of an axial magnetic field coil for generating an axial magnetic field for diffusion of an electric arc located in at least one arc formation area during said movement.

17. The vacuum cartridge according to claim 7, wherein the contacts have an external diameter and the diameter of the at least one orifice is a value comprising the product of between 0.1 and 0.3 times a number equal to the external diameter of the contacts.

18. The vacuum cartridge according to claim 7, wherein the axial magnetic diffusion field is a multipole field comprising a plurality of poles and at least one of the contacts comprises a plurality of orifices equal in number to said plurality of poles.

* * * * *